US006170092B1

(12) United States Patent
May

(10) Patent No.: US 6,170,092 B1
(45) Date of Patent: Jan. 9, 2001

(54) AIDS SPLASH BACK TOILET GUARD

(76) Inventor: Wade Norris May, 2895 E. Charleston Blvd. #2002, Las Vegas, NV (US) 89104

( * ) Notice: Under 35 U.S.C. 154(b), the term of this patent shall be extended for 0 days.

(21) Appl. No.: 09/476,881

(22) Filed: Jan. 4, 2000

(51) Int. Cl.[7] ..... E03D 9/00
(52) U.S. Cl. ..... 4/300.3
(58) Field of Search ..... 4/300.3, 661, 902

(56) References Cited

U.S. PATENT DOCUMENTS 6,081,937 * 7/2000 Whitacre ..... 4/300.3

* cited by examiner

*Primary Examiner*—Charles E. Phillips

(57) ABSTRACT

My Invention is called THE AIDS SPLASH BACK TOILET GUARD and as the name implies, it is a paper device that is used to protect a person from AIDS contaminated toilet water that can splash back when Bowel Movements are made. The Splash Back guard is a round paper towel pad about 7 inches in diameter and about ⅛th inch thick and it also has tiny pieces of styrofoam chips embedded within it. The pad is to be laid into the toilet on top of the water before a person sits to make a Bowel Movement. The pad will not sink until a Bowel Movement is made because the embedded styrofoam chips will cause it to float on top of the water. The idea is to make a Bowel Movement directly onto the top of the pad instead of onto the naked water. And by doing so, the impact of the fallen Feces upon the pad will force the water to splash outwards along the sides of the rim of the toilet instead of directly upwards to wet a person's Anal and Genital area. This invention is conceived with the intent of being a Lifesaving device since, in actuality, toilet water, after having been contaminated by the previous user with AIDS, can be deadly if the water splashes back and contact the openly exposed areas of the Anus and Vaginal regions.

3 Claims, 2 Drawing Sheets

WADE N. MAY, SR.

WADE N. MAY, SR.

AIDS SPLASH BACK TOILET GUARD

CROSS-REFERENCE TO RELATED APPLICATIONS

PTO Disclosure Document no. 433919 Mar. 10, 1998

STATEMENT REGARDING FEDERALLY SPONSORED RESEARCH OR DEVELOPEMENT

Not Applicable

REFERENCE TO A MICROFICHE APPEDIX

Not Applicable

BACKGROUND OF THE INVENTION

The field of endeavor to which this invention pertains is to the stopping of the spread of the disease AIDS into the general population by protecting people from contaminated toilet water splash backs when they sit to make a bowel movement.

My invention is a round circular paper towel pad that is to be laid into the toilet for which enclosed tiny pieces of styrofoam chips within the pad will allow it to float on top of the water. Next, the idea is to make a bowel movement directly onto the top of the pad instead of on top of the bare surface of the toilet water. By doing so, the impact of the fallen feces will cause the pad to force the splash of the water outwards along the sides of the rim of the toilet bowl instead of splashing directly back upwards to wet the person's anal or genital area which can cause an AIDS infection if the toilet water has already been contaminated with the HIV virus by the previous toilet user.

Of course, most people already know that you can't catch AIDS from a toilet seat by sitting on it to make a bowel movement. But the danger is not in "sitting on the seat". The true danger is in the toilet bowl water itself when it splashes back upwards during the initial bowel movement. This invention solves the problem of toilet water splash backs. And it also corrects the American Medical Association's veiws on in-home casual contacts.

According to the American Medical Association's belief, there are only two ways that a person can catch AIDS in their home (1) by having sex and (2) by shooting dope and exchanging dirty needles. But they say that you can catch AIDS from a blood transfusion or an organ transplant but that these procedures don't occur in a person's home but in a hospital. They also say that you can catch AIDS from an accidental needle puncture or a scapel cut or from blood clotting agents. But again these things are not normally found in one's home. Therefore, most doctors agree that if a person visits your home and regardless if he has AIDS and you know it or whether he has AIDS and you don't know it; as long as you don't intend to have sex with them or shoot dope with them, you don't have to worry about catching AIDS from them. And to further calm the fears on casual contact, doctors continually reiterate that you can't catch AIDS from hugging or kissing or from toilet seat or from touching other things that they have touched such as household furniture or kitchen utensiles. But they never mentioned toilet water splash backs. And because of this oversight, most people are thus blinded to the dangers of AIDS transmission posed by toliet water splash backs. This means that if a person who has AIDS uses a public toilet, whether he defecates or simply urinates, some of the AIDS virus will remain inside the toilet bowl even after the old water is flushed away. This correctly means that the next person that uses the same toilet will be at risk for the contraction of AIDS if he defecates and his feces splashes back the water for which it returns upwards and contact his anus. And this is especially true and more so dangerous when the person is experiencing bloody hemorrhoids or females who are experiencing bloody menstruation periods. In such cases, according to CDC interpretation, when AIDS contaminated water comes into contact with human blood, then the criterion for fluid to fluid contact will be established. This means that the risk factor for developing AIDS from toilet water splash backs is the same as being accidentally stuck by an infected dirty needle. This means that the "door" to AIDS transmission is now open from person to person just as it is open to people who share dirty needles or who receives blood transfusions or organ transplants since in these cases too the rule for bodily fluid to fluid contact is also established. Obviously, the best way to close this particular AIDS transmission door is to prevent the toilet water from splashing back in the first place.

Toilet water splash backs are a common occurance. Often when people are making a bowel movement, they will receive a sudden unconfortable sensation of colder water touching their warmer bodies. This sensation is called toilet water splash back. Indeed people have been having toilet water splash backs for as long as they have had indoor toilets instead of outhouses. And the thought of really dying from a splash back has never been of any real particular concern. But now the concerns of splash backs must be recognized as a legitimate threat requiring preventative care. After all, at one time even a simple blood transfusion, although displeasing and uncomfortable, was never considered a deadly act. However, the spread of AIDS has brought concern and care now even to blood transfusions simply because the "door" to AIDS transmission is open when transfusions are occurring. In other words, using a toilet behind an AIDS infected person and receiving his toilet water splash back is just as risky as receiving a blood transfusion from that same person. And sadly, the same rule that applies to public toilets between strangers also applies to home toilets when guests come to visit, and between parents and children when one household member becomes infected.

Actually, among the general population, most parents and school children are well educated in knowing that you can't catch AIDS from a toilet seat by sitting down. Adding to this security most people lay down a pre-cut paper seat guard on the seat or line the seat with toilet paper before sitting. This makes them feel safe. And in believing that AIDS cannot get to them from a toilet seat especially lined with paper, they are thus blinded to the fact that the toilet bowl itself is the real danger and not the seat. And since the spread of AIDS is threatening to advance into the general heterosexual population, then it would be wise to protect ourselves from the splash back risk in our homes. Needless to say, anyone can have AIDS or the virus that leads to AIDS and not be aware of it. They can appear quite healthy and well. And for this reason, a friend or a neighbor or even a healthy looking stranger who visits your home and uses your toilet may, unknowingly, plant the infection that may end up killing you and your whole family. And since this threat by visitors becomes greater as heterosexual contractions increases, then this AIDS transmission "door" must be closed to the public. And the easiest, safest, most practicable way to do it is to lay down a pre-cut circular paper towel pad on top of the water in the toilet bowl before making a bowel movement—which describes my invention , THE AIDS SPLASH BACK TOILET GUARD.

BRIEF SUMMARY OF THE INVENTION

My invention, THE AIDS SPLASH BACK TOILET GUARD, is a round floatable paper towel pad which is to be placed in the toilet on top of the water before making a bowel movement. The object of THE AIDS SPLASH BACK TOILET GUARD is to separate a person's body from their toilet water when they are making a bowel movement. Normally a person's body is already separated from their toilet water by a space of about a few inches between the top of the water and the bottom of their buttocks. However, these few inches can be easily transcended and reached by the physical actions of a swift splash back of water. Needless to say, all people don't always receive toilet water splash backs everytime they make a bowel movement. However, on occassions, depending upon the configuration of the fallen feces itself, toilet water splash backs do occur and are instantly felt as wet water upon the anal and genital areas of the body. And this is extremely dangerous if the toilet water is already contaminated with the AIDS virus by the previous user.

DETAILED DESCRIPTION OF THE INVENTION

Figure 1:
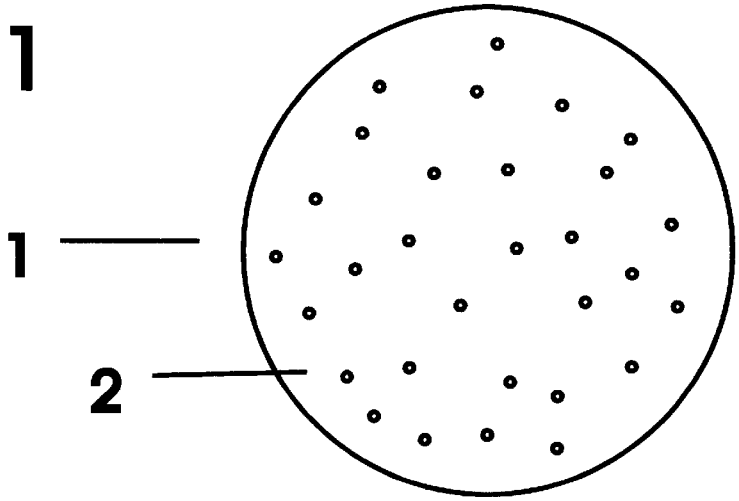
Figure 2:
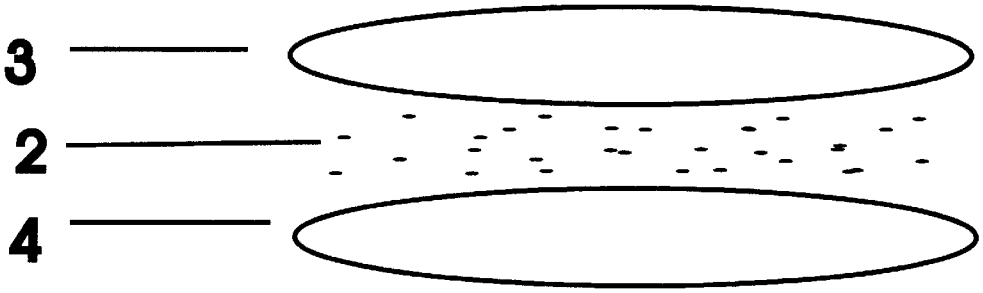
FIG. 2 shows the composition of the splash back pad which are the two halves of the paper towels and the tiny pieces of styrofoams chips that goes between them. There are approximately 186 tiny pieces of styrofoam chips of which each are about 1/16 th inch cubed shaped.
Figure 3:
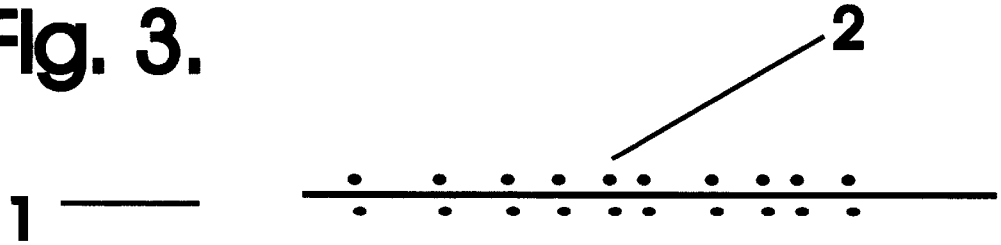
FIG. 3 shows the thickness of a completed splash back pad with its top and bottom layers glued together enclosing the styrofoam chips. The thickness is 1/8 inch.
Figure 4:
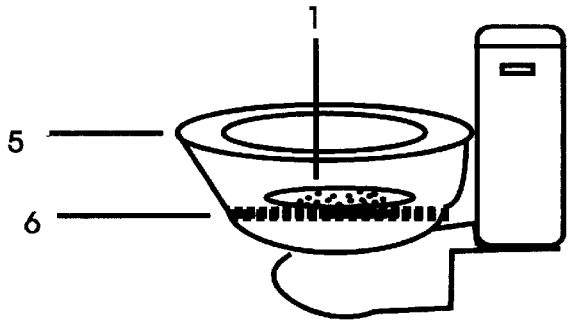
FIG. 4 shows a diagram of the average american toilet and how the splash back pad is to be laid into the toilet just before a person sits to make a bowel movement.
Figure 5:
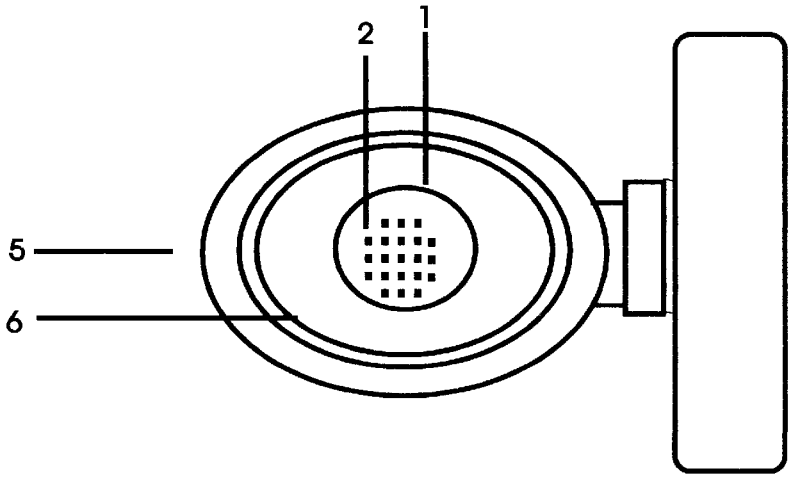
FIG. 5 shows the top veiw of the toilet and how the splash back pad becomes soaked with water but does not sink from the top.
Figure 6:
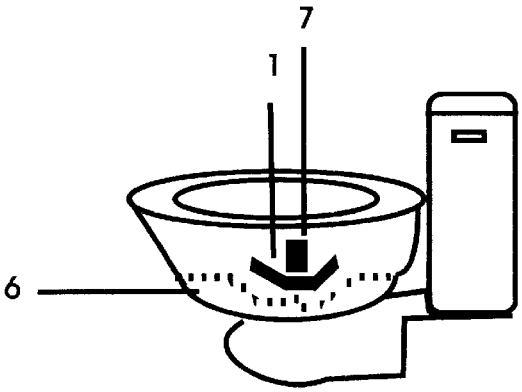
FIG. 6 demonstrates the impact of how the fallen feces hits and bends the splash back pad thus forcing the toilet water outwards harmlessly along the sides of the rim of the bowl.

My invention is called the AIDS SPLASH BACK TOILET GUARD. This invention is a round circular paper towel pad that floats on the top of toilet water in a toilet bowl. When making a bowel movement, the purpose of this invention is to redirect the splash of the toilet water outwards along the sides of the rim of the toilet bowl instead of splashing directly back upwards to contact a person's body. And by so doing, this invention will stop the spread of AIDS from person to person when the virus is freshly present in the toilet water. By preventing the splash of the toilet water from returning upwards to touch a person's body, the invention simultaneously prevents the AIDS virus from contacting that same person's anal and genital areas.

Referring to FIG. (1), 1 shows the pad, its face and describes its diameter which is approximately 7 inches. 2 depicts the smooth bumps in the paper pad made by the protruding styrofoam chips that will make it float.

FIG. (2) shows the composition of the splash back pad. 2 shows the small pieces of styrofoam chips that will enable floatation to be possible. 3 points to the top half layer of the splash back pad. 4 points to the bottom half layer of the pad.

FIG. (3) shows the side veiw of a completed splash back pad and its thickness. It shows its top and bottom layers glued together enclosing the floatable styrofoam chips. The thickness of the pad is approximately 1/8 inch. 1 shows the whole pad. 2 shows the smooth bumps in the paper made by the protruding styrofoam chips that make it float.

FIG. (4) shows a diagram of an average american toilet and how the AIDS splash back toilet pad is to be laid into it just before a person sits to make a bowel movement. 1 shows the whole pad inside the toilet bowl. 5 points to the toilet seat. 6 shows the water line level at which the pad floats.

FIG. (5) shows the top veiw of the toilet and how the splash back pad becomes soaked with water but does not sink from the top. 1 shows the whole pad lying in the toilet. 2 points to the styrofoam chips within the pad that allows it to float on the top of the water. 5 points to the toilet seat. 6 shows the water line level within the toilet bowl upon which the pad is laid before a bowel movement is made.

FIG. (6) demonstrates the process of protection during the actual bowel movement. The falling feces hits the pad and bends it downwards which shatters the water line and forces the splash outwards along the sides of the rim of the bowl instead of upwards to wet the body. 1 shows the splash back pad bending. Line 6 shows how the toilet bowl water line level is being forced outwards by the impact of the bending pad. 7 depicts the action of a bowel movement wherein the first of the fallen feces hits and bends the splash back pad.

I estimate that the total thickness of the pad including the two sides of the paper towels, the glue, and the enclosed thin pieces of styrofoam chips will be about 1/8 inch thick. However, it may extend to 3/16 inch but no greater since further thickness risk clogging and causing toilet jams. As far as manufacturing is concerned, making and putting together this invention is just a matter of cutting two pieces of regular paper towels into a circle of 7 inches in diameter. Lay one side on a table and with a brush spread a thin layer of glue on it. Then before the glue dries, sprinkle small amounts of the styrofoam chips sparingly throughout the pad. Next, brush glue on the second paper towel and lay it on top of the styrofoam chips thereby sealing them inside and making the pad a floatation device that won't sink.

Needless to say, on a mass production level involving assembly line machinery and large numbers of workers, such steps as cutting paper, glueing, and sprinkling styrofoam chips to make a floatable pad may at a future date be produced as easily as one single pad that has been automatically interwoven with styrofoam. But since at present I don't have access to the technological advances to build a single sheet pad with built in styrofoam chips, my simple way of glueing the two paper towels together with the enclosed styrofoam chips will prevent the spread of AIDS just as well when a person sits to make a bowel movement.

What I claim as my invention is:

1. A pad that floats on top of toilet water in a toilet bowl comprising;

two circular pieces of thin paper towel material approximately seven inches in diameter, one piece forming a top of said pad and the other piece forming the bottom of said pad, each piece being at least partially coated with glue on facing surfaces so as to enclose therebetween pieces of styrofoam which will cause the pad to float on top of water in a toilet bowl when said pad is placed thereon.

2. The pad of claim 1, wherein the thickness of said pad lies in a range of one-eighth of an inch to three-sixteenths of an inch.

3. The pad of claim 1 wherein the pad comprises approximately 186 pieces of styrofoam and each piece is approximately one-sixteenth of an inch cubed.

* * * * *